US005694157A

United States Patent [19]

Ahlvin

[11] Patent Number: 5,694,157

[45] Date of Patent: Dec. 2, 1997

[54] MULTIPLE WIPER SERVICING SYSTEM FOR INKJET PRINTHEADS

[75] Inventor: Eric L. Ahlvin, Vancouver, Wash.

[73] Assignee: Hewlett-Packard Company, Palo Alto, Calif.

[21] Appl. No.: 330,765

[22] Filed: Oct. 28, 1994

[51] Int. Cl.[6] ..... B41J 2/165

[52] U.S. Cl. ..... 347/24; 347/33

[58] Field of Search ..... 347/22, 24, 30, 347/33, 32

[56] References Cited

U.S. PATENT DOCUMENTS

| | | | |
|---|---|---|---|
| 4,306,245 | 12/1981 | Kasugayama et al. | 346/140 R |
| 4,853,717 | 8/1989 | Harmon et al. | 346/140 R |
| 4,935,753 | 6/1990 | Lehmann et al. | 346/140 R |
| 5,051,761 | 9/1991 | Fisher et al. | 346/140 |
| 5,081,472 | 1/1992 | Fisher | 346/140 R |
| 5,103,244 | 4/1992 | Gast et al. | 346/1.1 |
| 5,115,250 | 5/1992 | Harmon et al. | 346/1.1 |
| 5,138,343 | 8/1992 | Aichi et al. | 347/30 |
| 5,151,715 | 9/1992 | Ward et al. | 346/140 R |
| 5,155,497 | 10/1992 | Martin et al. | 346/1.1 |
| 5,300,958 | 4/1994 | Burke et al. | 346/140 R |
| 5,396,271 | 3/1995 | Premnath | 347/33 |
| 5,489,927 | 2/1996 | Harmon | 347/33 |

FOREIGN PATENT DOCUMENTS

| | | | |
|---|---|---|---|
| 0589582 | 3/1994 | European Pat. Off. | B41J 2/165 |
| 59-45162 | 3/1984 | Japan | 347/33 |
| 59-45163 | 3/1984 | Japan | 347/33 |
| 59-209876 | 11/1984 | Japan | 347/33 |
| 62-111751 | 5/1987 | Japan . | |
| 62-251146 | 10/1987 | Japan | B41J 3/04 |
| A2231143 | 7/1990 | Japan | B41J 2/165 |
| 2-202452 | 8/1990 | Japan | 347/33 |
| A2235761 | 9/1990 | Japan | B41J 2/165 |
| 3-90362 | 4/1991 | Japan | 347/33 |
| 3-99857 | 4/1991 | Japan | 347/33 |
| 3-189163 | 8/1991 | Japan | 348/33 |
| 3290259 | 12/1991 | Japan | B41J 2/165 |
| 4-37556 | 2/1992 | Japan | 347/33 |
| 4-77263 | 3/1992 | Japan . | |
| A4110156 | 4/1992 | Japan | B41J 2/165 |
| A4141440 | 5/1992 | Japan | B41J 2/165 |
| 4-338552 | 11/1992 | Japan | 347/33 |
| A5116331 | 5/1993 | Japan | B41J 2/165 |
| 5-162320 | 6/1993 | Japan | B41J 2/165 |
| 6-143597 | 5/1994 | Japan | 347/33 |

*Primary Examiner*—John E. Barlow, Jr.

[57] ABSTRACT

An inkjet printing mechanism has n printheads with nozzle sections and a carriage to carry the n printheads, where n≧2. The carriage is movable through a print zone to one of two servicing positions at a service station beside the print zone. A wiper assembly is mounted at the service station to clean the nozzle sections of the printheads. The wiper assembly has n+m wipers where m wiper(s) clean at least one printhead when the carriage is located at a first servicing position, and the n wipers clean all n printheads simultaneously when the carriage is located at a second servicing position.

18 Claims, 3 Drawing Sheets

MULTIPLE WIPER SERVICING SYSTEM FOR INKJET PRINTHEADS

TECHNICAL FIELD

This invention relates to ink-jet printing mechanisms, and more particularly, to wiper assemblies used in ink-jet printers, plotters, scanners, facsimile machines, and the like.

BACKGROUND OF THE INVENTION

An inkjet printing mechanism is a type of non-impact printing device which forms characters and other images by controllably spraying drops of ink from a printhead. Inkjet printing mechanisms may be employed in a variety of devices, such as printers, plotters, scanners, facsimile machines, and the like. For convenience, inkjet printers are used herein to illustrate the concepts of the present invention.

The printhead ejects ink through multiple nozzles in the form of drops which travel across a small air gap and land on a recording media. The drops are very small. Inkjet printers commonly print within a range of 180 to 600 dots per inch (dpi). The ink drops dry on the recording media shortly after deposition to form the desired printed images.

There are various types of inkjet printheads including, for example, thermal inkjet printheads and piezoelectric inkjet printheads. By way of example, for a thermal inkjet printhead, ink droplets are ejected from individual nozzles by localized heating. A small heating element is disposed at individual nozzles. An electrical current is passed through the element to heat it up. This causes a tiny volume of ink to be rapidly heated and vaporized by the heating element. Once vaporized, the ink is ejected through the nozzle. A driver circuit is coupled to individual heating elements to provide the energy pulses and thereby controllably deposit ink drops from associated individual nozzles. Such drivers are responsive to character generators and other image forming circuitry to energize selected nozzles of the printhead for forming desired images on the recording media.

During printing, ink tends to build up at the nozzle orifices on the printhead. This build-up can be caused by ink droplets that are not completely ejected, excess ink at the orifice that is not vaporized during ejection, or ink splatterings that reflect from the recording media. The resident ink on the printhead can clog the nozzle orifices and detrimentally disrupt or impair proper printing.

Conventional inkjet printers are often equipped with movable service station mechanisms that include wiper assemblies designed to periodically clean the nozzle section of the inkjet printhead to remove any resident ink. Typically, the wiper assembly has one individual wiper for each printhead which engages and scrubs the printhead orifices. The wiper assembly is alternately moved to an activated position suitable for cleaning the printhead and then to a retracted position where it does not interfere with the printhead during printing.

SUMMARY OF THE INVENTION

According to one aspect of the present invention, a wiper assembly is provided for an inkjet printing mechanism that employs multiple printheads. The printheads are moved from a print zone to a service station to be cleaned. The wiper assembly has a first wiper portion for cleaning a first set of at least one printhead and a second wiper portion for simultaneously cleaning a second set of multiple printheads.

In the illustrated embodiment, the wiper assembly has n+1 discrete wipers, where n is the number of printheads. The printheads include a primary printhead, such as a Black pen, and multiple secondary printheads, such as Cyan, Magenta, and Yellow pens. The four printheads (i.e., n=4) are arranged in a carriage such that the primary printhead is proximally closer to the service station than the secondary printheads. The wiper assembly has a primary wiper and four secondary wipers. The primary wiper is proximally closer to the print zone than the secondary wipers. The primary wiper cleans only the primary printhead (i.e., the Black pen) when the carriage is at a first servicing position. The secondary wipers clean all four printheads (i.e., the Black, Cyan, Magenta, and Yellow pens) when the carriage is at a second servicing position.

BRIEF DESCRIPTION OF THE DRAWINGS

Preferred embodiments of the invention are described below with reference to the following accompanying drawings. The drawings depict examples embodying the best mode for practicing the invention.

FIG. 1 shows a movable carriage holding multiple printheads and a wiper assembly. The wiper assembly is constructed according to a first preferred embodiment.

DETAILED DESCRIPTION OF THE PREFERRED EMBODIMENTS

The present invention relates to inkjet printing mechanisms which can be used in many different printing devices, including inkjet printers, plotters, scanners, facsimile machines, and the like. In general, an inkjet printing mechanism has one or more inkjet printheads which controllably deposit drops of ink in prescribed patterns onto a recording media. As used herein, recording media includes all forms of printable matter including, for example, continuous paper, sheet stock paper, adhesive backed labels, mylar, and the like. A typical inkjet printhead has multiple nozzles (e.g., 50 nozzles), such as that described in U.S. Pat. No. 5,278,584 by Keefe et al., which is assigned to Hewlett-Packard Company.

Figure 1:
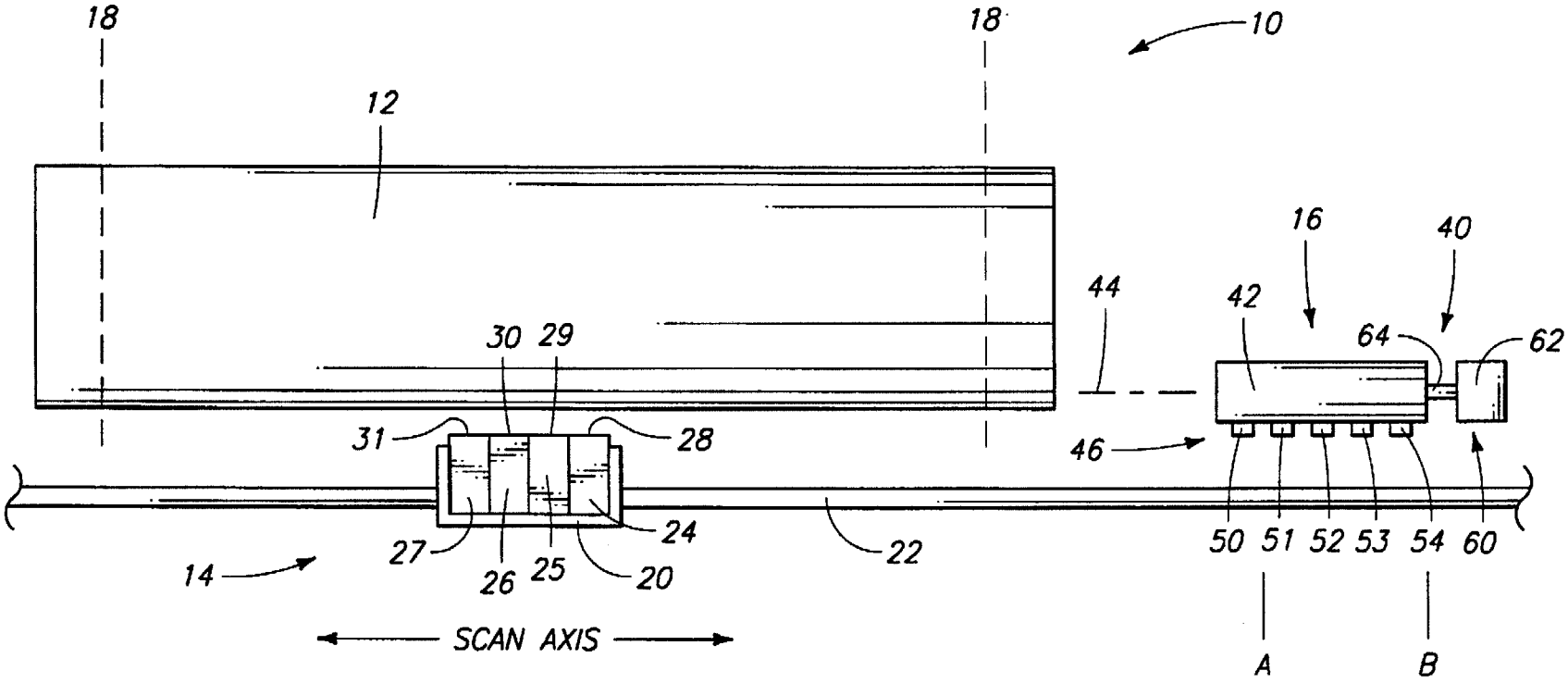
FIG. 1 is a diagrammatical top view of one form of an inkjet printing mechanism according to this invention.

Aspects of this invention may be implemented in printing mechanisms having one or multiple printheads. FIG. 1 shows one embodiment of a shuttle-type inkjet printing mechanism 10 constructed according to this invention which has multiple printhead. Printing mechanism 10 includes a platen 12, a shuttle assembly 14, and a service station 16. Platen 12 supports a recording media (not shown) during printing. The platen can be stationary, or rotatable to assist in advancing the media through the printing mechanism. A media feed mechanism (not shown), such as conventional friction rollers or a tractor feed system, may be used to drive the media through the printing mechanism along a media feed path.

Printing mechanism 10 has a predefined print zone which is represented by dashed boundary lines 18. The print zone coincides at least partially with the media feed path so that the recording media is fed through the print zone. An example print zone is defined as an area within which each of the multiple printheads can print across the entire width of the recording media.

Shuttle assembly 14 includes a carriage 20 slidably mounted on a fixed, elongated guide rod 22 to move bidirectionally across platen 12. Carriage 20 is designed to maneuver over the full width of the platen, thereby entirely traversing print zone 18, as well as moving to service station 16 outside of the print zone. Shuttle assembly 14 includes a drive subassembly (not shown) that is mechanically coupled to drive carriage 20 back and forth along rod 22. A typical drive subassembly includes a wire or belt attached to carriage 20 and wound around opposing pulleys, and a motor (e.g., a stepper motor or DC motor) connected to power one of the pulleys. A rotary encoder is coupled to the motor drive shaft to monitor incremental shaft rotation and provide feedback data for use in positioning and controlling the carriage. The shuttle assembly 20 described herein is provided for explanation purposes and its construction is well known in the art. Other types of shuttle assembly configurations may alternatively be employed in the printing mechanism 10.

Carriage 20 supports and carries n printheads (where $n \geqq 2$) which are preferably embodied as replaceable, disposable print cartridges or pens. In this embodiment, carriage 20 is shown as carrying four printheads 24, 25, 26, and 27 (i.e., n=4). The multiple printheads 24–27 have respective nozzle sections 28, 29, 30, and 31. The printheads 24–27 are mounted to carriage 20 so that nozzle sections 28–31 are adjacent to, but spaced from, platen 12 to permit passage of the recording media therebetween. The carriage moves the printheads back and forth through the print zone 18 in horizontal swaths along the scan axis. A variety of different carriage subsystems can be used in conjunction with this invention. One example construction of a carriage subsystem which supports multiple printheads is described in U.S. Pat. No. 5,109,239, assigned to Hewlett-Packard Company.

Multiple printheads 24–27 preferably contain ink of different colors. One preferred arrangement that will be referenced throughout this disclosure is as follows: printhead 24 comprises a pen which prints Black; printhead 25 comprises a pen that prints the color Cyan; printhead 26 comprises a pen that prints the color Magenta; and printhead 27 comprises a pen that prints the color Yellow.

A wiper assembly 40 is mounted at service station 16 to clean nozzle sections 28–31 of printheads 24–27. The printheads are cleaned periodically during operation. The printing mechanism schedules routine servicing based upon the printing time, the number of ink drops being ejected, and other factors. As an example, the printheads may be cleaned approximately once every minute or once every page of a sheet stock recording media.

When ready for servicing, carriage 20 moves printheads 24–27 outside of print zone 18 to service station 16. In the illustrated embodiment, carriage 20 moves the printheads to a first servicing position, referenced by the letter A (FIG. 2), and/or to a second servicing position, referenced by the letter B (FIG. 3). In general, wiper assembly 40 has a first wiper portion which cleans a first set of at least one printhead nozzle section when the carriage is located at the first servicing position A. The wiper assembly also has a second wiper portion which simultaneously cleans a second set of multiple printheads when the carriage is located at the second servicing position B.

Wiper assembly 40 includes a central core member 42 extending along a longitudinal axis 44. Core member 42 is shown in the shape of a cylindrical barrel (see also FIG. 4), although other shapes can be used. Wiper assembly 40 further has a wiping mechanism 46 attached to core member 42 and radially extending from longitudinal axis 44. Wiper mechanism 46 has n+m wiping regions, where $n \geqq 2$ and $m \geqq 1$. In the illustrated preferred embodiment of a four printhead printing mechanism (i.e., n=4), the wiper mechanism has five wiping regions (i.e., m=1, n+m=5) in the form of discrete, deflectable, resilient wipers 50, 51, 52, 53, and 54. These wipers are used to alternately clean the nozzle sections of all four printheads 24–27 or clean at least one nozzle section of a subset of the four printheads. The wipers are preferably formed of a resilient material, such as rubber, an elastomer, or a plastic.

Figure 5:
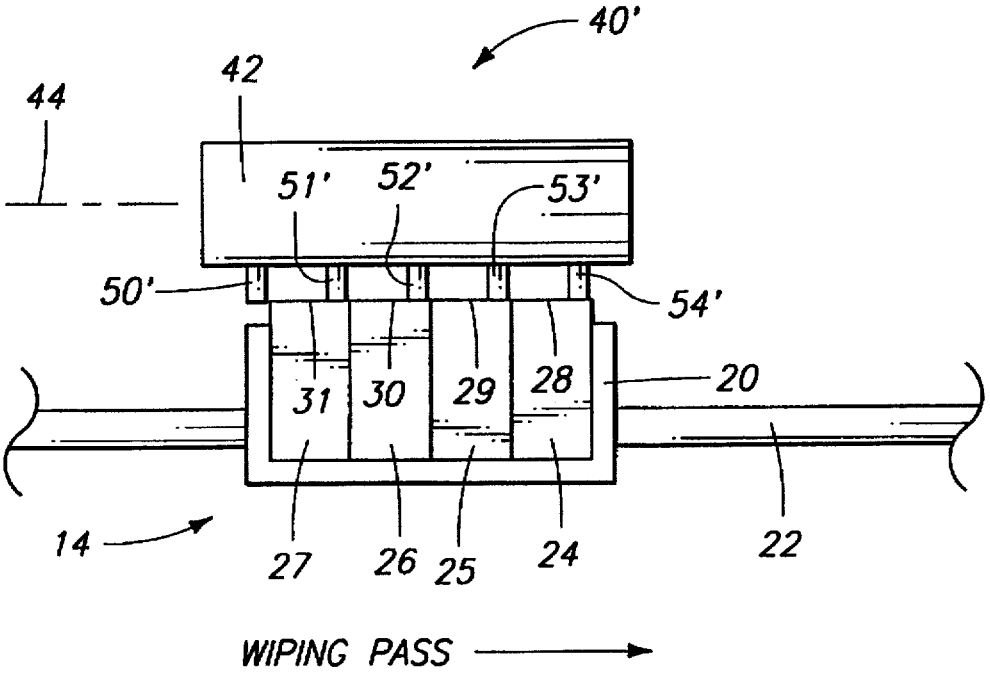
FIG. 5 is a diagrammatical top view of a wiper assembly according to a second preferred embodiment and illustrates a cleaning technique.

The illustrated individual discrete wipers each have an elongated blade which engages and wipes associated printhead nozzle sections to remove ink build-up. The blade has sufficient width to wipe a cleaning path over all of the inkjet orifices in one swipe. In one preferred embodiment, the elongated wiping surface of the blades are aligned substantially in parallel with the longitudinal axis 44 as shown in FIG. 1. In a second embodiment, the elongated wiper surface of the blades are aligned substantially perpendicular to the longitudinal axis as shown in FIG. 5. While many different wiper constructions may be employed in this invention, an example wiper construction is described in U.S. Pat. No. 5,151,715, assigned to Hewlett-Packard Company.

Although discrete wipers are preferred, other wiper mechanisms, may be used. For instance, wiper mechanism 46 may be implemented as a single integral wiper having n+m multiple wiper sections of sufficient width to clean associated nozzle sections. Wipers other than the illustrated blade configuration may also be used.

In the preferred construction, wiper assembly 40 further includes a drive mechanism 60 that rotates central core member 42 about longitudinal axis 44 to cause the discrete wipers 50–54 to clean corresponding nozzle sections of the printheads. In the illustrated embodiment, the drive mechanism 60 comprises a small motor 62 and a drive shaft 64 which interconnects the motor to core member 42. Alternatively, the drive mechanism 60 may comprise a conventional drive coupling device (not shown) that is mechanically coupled to and powered by a separate power source (such as the motor used in the media feed mechanism).

For purposes of continuing discussion, printhead 24 (which is preferably a Black pen) is designated as the primary printhead. The Black pen 24 is typically the most often used and thus this designation is suitable for discussion purposes. The three remaining color printheads 25–27 (i.e., the Cyan, Magenta, and Yellow pens) are designated as secondary printheads. The four printheads are arranged in carriage 20 such that the Black primary printhead 24 is proximally closer to service station 16 along the scan axis than the multi-colored secondary printheads 25–27.

With respect to the illustrated wiper assembly 40, wiper 50 is designated as the primary wiper and the remaining wipers 51–54 are designated as the secondary wipers. The five wipers are arranged along core member 42 in a desired order such that primary wiper 50 is proximally closer to print zone 18 than secondary wipers 51–54.

Figure 2:
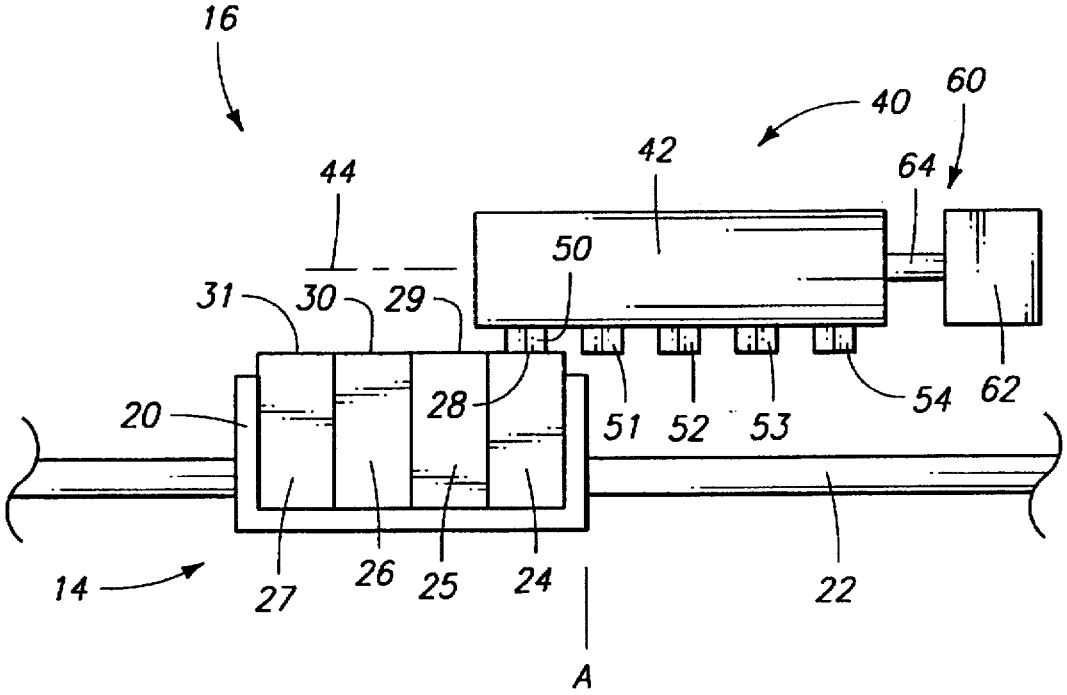
FIG. 2 is a diagrammatical top view of the carriage and printheads at a first servicing position relative to the wiper assembly.
Figure 3:
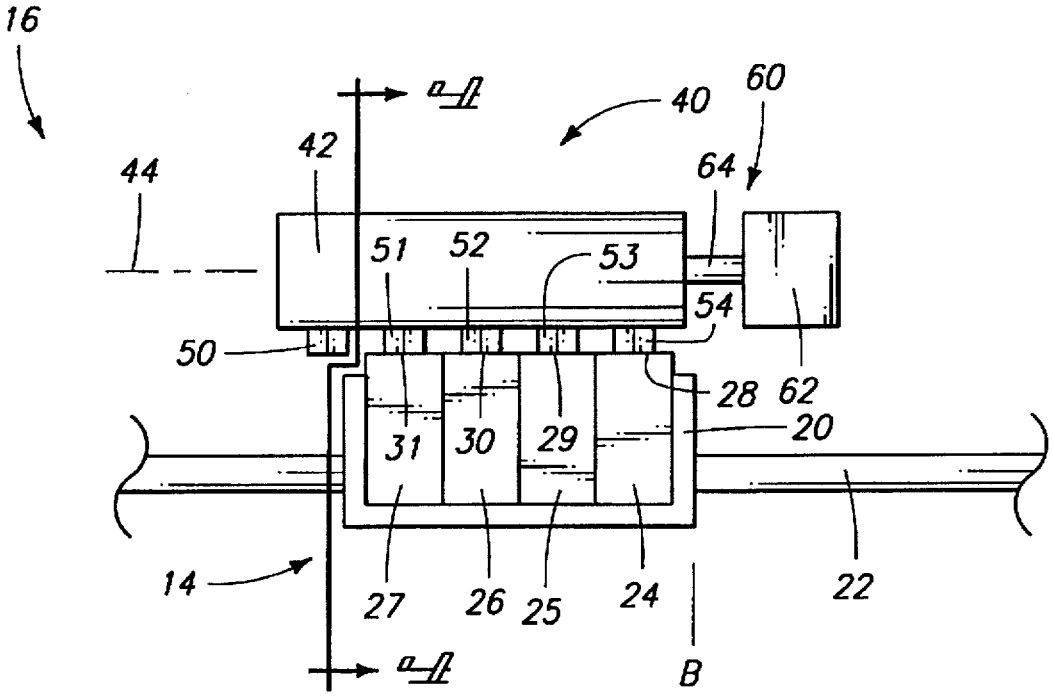
FIG. 3 is a diagrammatical top view of the carriage and printheads at a second servicing position relative to the wiper assembly.

FIGS. 2 and 3 show service station 16 in more detail. The preferred cleaning method of operation of inkjet printing mechanism 10 is also described with respect to these figures. In FIG. 2, the carriage 20 is moved to the first servicing position A at service station. 16. When the carriage is at position A, the primary wiper 50 of wiper assembly 40 overlaps with and cleans the Black primary printhead 24. Notice that position A is the closest cleaning position to print zone 18. As a result, carriage 20 is conveniently moved only a minimal distance outside of the print zone when cleaning primary printhead 28. In the past, some service stations included only four wipers, one for each pen, so the carriage had to traverse the entire service station width to clean the Black pen. Further, all four pens were wiped during each servicing, even though perhaps only the Black pen had been used in printing. Using the illustrated wiper assembly, overtravel of the carriage in the service station region is minimized. This efficient configuration enhances throughput of the printing mechanism 10 by minimizing the non-printing time used for moving the primary printhead 28 into position for cleaning.

In FIG. 3, the carriage is moved to the second servicing position B at service station 16. When the carriage is at position B, the secondary wipers 51–54 of wiper assembly 40 simultaneously clean both the Black primary printhead 24 and the multi-colored secondary printheads 25–27. The multiple wipers quickly and efficiently clean all four printheads to minimize the non-printing time lapse that occurs during servicing.

Many alternative wiping combinations can be performed. For example, the carriage may be moved to a servicing position intermediate of positions A and B where, for example, wipers 50–52 clean printheads 24–26. In the most general terms, the n+m wipers have m wipers which clean at least one printhead and n wipers which clean all n printheads simultaneously. In the illustrated example of five wipers per four printheads (i.e., n=4 and m=1), the first wiper cleaned one printhead and the second through fifth wipers cleaned all four printheads. In another example, where there are seven wipers per five printheads (i.e., n=5 and m=2), the first and second wipers could clean two printheads and the third through seventh wipers could clean all five printheads.

Figure 4:
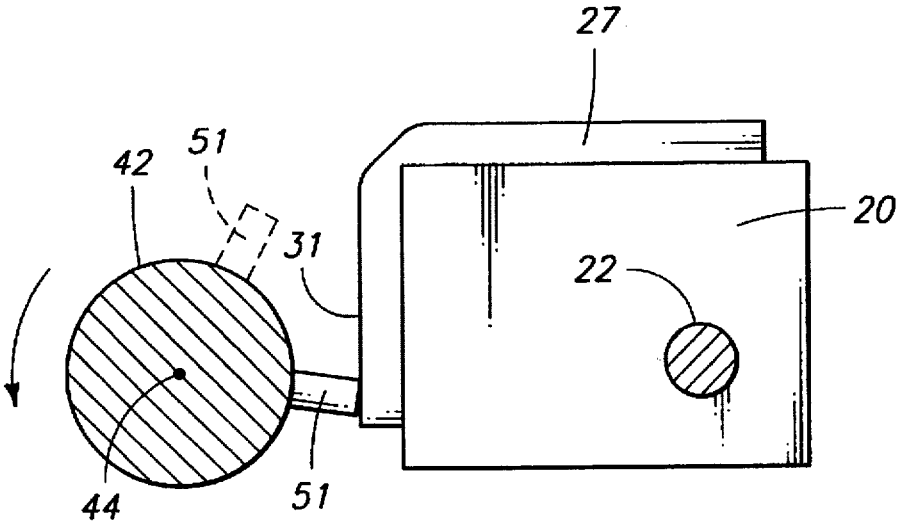
FIG. 4 is a diagrammatical side view of the printheads taken along line 4—4 of FIG. 3 to illustrate one cleaning technique where the wiper assembly rotates to clean the printheads.

FIGS. 4 and 5 show two preferred techniques for performing the actual cleaning task. In FIG. 4, core member 42 is rotated about longitudinal axis 44 to cause the wipers (represented by wiper 51) to contact and wipe the nozzle sections (represented by nozzle section 31) of the printheads (represented by printhead 27). This scrubbing action cleans the nozzle sections to remove excess ink from the nozzle orifices, which prevents ink build-up and clogging of the printhead nozzle orifices. Upon completion of the cleaning step, the core member 42 is rotated to disengage the wipers and place them in a rest position, for instance as shown in dashed lines in FIG. 4, where they do not interfere with the motion of the printheads and carriage.

FIG. 5 shows a second cleaning technique using a wiper assembly 40' of the second embodiment which employs wipers 50'–54' that are substantially perpendicular to longitudinal axis 44. Wipers 51'–54' are brought into a wiping position to contact with nozzle sections 28–31 of printheads 24–27 by a movable rack construction (not shown), or the like, such as that described in U.S. Pat. No. 5,151,715. In contrast to the rotating technique of FIG. 4, when in the wiping position (FIG. 5), wiper assembly 40' remains stationary during cleaning. Here, carriage 20 moves the printheads along respective wipers 50' or 51'–54' as illustrated by the "wiping pass" notation in FIG. 5. As the printheads are moved past the stationary wipers, the wipers contact and scrape respective nozzle sections to clean the printheads. In the first wiping position, only the Black pen nozzle section 28 is cleaned by wiper 50', whereas in the second position, all four nozzle sections 28–31 are wiped by respective wipers 51'–54'.

Many advantages are realized by using the illustrated wiping schemes. For example, two unique wiping algorithms may be employed depending upon whether only the Black pen 24 or all four pens 24–27 are scheduled to be wiped. This selection capability decreases the time required for wiping, thereby increasing throughput. Additionally, these wiping schemes prevent excessive wiping of the pens, particularly the color pens 25–27. The wear caused by excessive wiping of color pens may reduce the useful life and reliability of such pens. Instead, by selectively wiping the color pens only when desired, rather than wiping the color pens automatically every time the more frequently used Black pen is cleaned, wear on the color pens is reduced and their reliability increases.

Another advantage of these wiping schemes is that the arrangement of the primary printhead 24 relative to the primary wiper 50, 50' reduces the overtravel of the carriage system 20 during servicing. This feature also improves throughput by reducing the down-time required for servicing.

A further advantage of these wiping schemes is that the inkjet printing mechanism 10 may clean one printhead exclusively, or multiple printheads simultaneously depending upon the positioning of the carriage 20. The flexible cleaning operations are conveniently controlled by the same existing controllers used to move and position the carriage along guide rod 22. Thus, no special positioning control intelligence is needed in the wiper assembly.

I claim:

1. An inkjet printing mechanism, comprising:

multiple printheads having respective nozzle sections;

a carriage to carry the multiple printheads, the carriage being movable through a print zone to a service station; and a wiper assembly mounted at the service station to clean the nozzle sections of the printheads, the wiper assembly having a first wiper portion for wiping the nozzle section of at least one of the multiple printheads and a second wiper portion for simultaneously wiping the nozzle sections of the multiple printheads without use of the first wiper portion.

2. An inkjet printing mechanism according to claim 1 wherein the wiper assembly comprises multiple discrete wipers.

3. An inkjet printing mechanism according to claim 1 wherein:

the carriage is configured to move to first and second servicing positions at the service station;

the first wiper portion wipes the printhead nozzle section when the carriage is moved to the first servicing position; and the second wiper portion simultaneously wipes the nozzle sections of the multiple printheads when the carriage is moved to the second servicing position.

4. An inkjet printing mechanism according to claim 3 wherein the first servicing position is closer to the print zone than the second servicing position.

5. An inkjet printing mechanism according to claim 1 wherein the wiper assembly comprises:

a central core member extending along a longitudinal axis; and multiple discrete wipers attached to the central core member and radially extending from the longitudinal axis, the wipers having elongated blades which are aligned substantially in parallel with the longitudinal axis.

6. An inkjet printing mechanism according to claim 5 wherein the wiper assembly comprises a drive mechanism coupled to rotate the central core member about the longitudinal axis.

7. An inkjet printing mechanism according to claim 1 wherein the wiper assembly comprises:

a central core member extending along a longitudinal axis; and multiple discrete wipers attached to the central core member and radially extending from the longitudinal axis, the wipers having elongated blades which are aligned substantially perpendicular to the longitudinal axis.

8. An inkjet printing mechanism according to claim 7 wherein the carriage moves the printheads along the wipers to cause the discrete wipers to clean corresponding nozzle sections of the printheads.

9. An inkjet printing mechanism, comprising:

a plurality of printheads having respective nozzle sections, wherein a variable n represents a number of the printheads;

a carriage to carry the n printheads, the carriage being movable to first and second servicing positions within a service station; and a wiper assembly mounted at the service station to clean the nozzle sections of the printheads, the wiper assembly having a number of individual discrete wipers represented by a variable n+m, where the m wipers clean at least one of the n printheads when the carriage is at the first servicing position, and the n wipers clean the n printheads simultaneously when the cartage is at the second servicing position.

10. An inkjet printing mechanism according to claim 9 wherein m equals one so that the wiper assembly has n+1 wipers.

11. An inkjet printing mechanism according to claim 9 wherein:

the wiper assembly comprises:

a central core member extending along a longitudinal axis;

the n+m discrete wipers being attached to the central core member and radially extending from the longitudinal axis, the wipers having elongated blades which are aligned substantially perpendicularly to the longitudinal axis; and the carriage moves the printheads along the wipers to cause the discrete wipers to clean the corresponding nozzle sections of the printheads.

12. An inkjet printing mechanism according to claim 9 wherein:

the n printheads comprise a primary printhead and at least one secondary printhead, the n printheads being arranged in the carriage such that the primary printhead is proximally closer to the service station than the secondary printhead;

the n+m wipers of the wiper assembly comprise a primary wiper and at least two secondary wipers, the wiper assembly being mounted at the service station in such a manner that the primary wiper is proximally closer to the prim zone than the secondary wipers;

the primary wiper cleans the primary printhead when the cartage is at the first servicing position; and the secondary wipers clean both the primary printhead and the secondary printhead when the carriage is at the second servicing station.

13. An inkjet printing mechanism according to claim 9 wherein the wiper assembly comprises:

a central core member extending along a longitudinal axis;

the n+m discrete wipers being attached to the central core member and radially extending from the longitudinal axis, the wipers having elongated blades which arc aligned substantially in parallel with the longitudinal axis; and a drive mechanism coupled to rotate the central core member about the longitudinal axis.

14. A method for cleaning inkjet printheads in an inkjet printing mechanism, the method comprising the following steps:

moving the inkjet printheads to a first servicing position;

cleaning at least one of the inkjet printheads while the inkjet printheads are located at the first servicing position using a first wiper portion of a wiping assembly;

moving the inkjet printheads to a second servicing position; and simultaneously cleaning the inkjet printheads while the inkjet printheads are located at the second servicing position using a second wiper portion of the wiping assembly different from the first wiper portion.

15. A wiper assembly for use in an inkjet printing mechanism to clean nozzle sections of multiple inkjet printheads, where a variable n represents a number of the printheads, the wiper assembly comprising:

a central core member extending along a longitudinal axis; and a wiping mechanism attached to the central core member and radially extending from the longitudinal axis, the wiping mechanism having a number of individual discrete wipers represented by a variable n+m to (1) clean the nozzle sections of all n printheads simultaneously using the n wipers, and (2) clean at least one nozzle section of a subset of the n printheads using the m wipers.

16. A wiper assembly according to claim 15 further comprising a drive mechanism coupled to rotate the central core member about the longitudinal axis.

17. A wiper assembly according to claim 15 wherein the individual discrete wipers comprises an elongated blade which is aligned substantially in parallel with the longitudinal axis.

18. A wiper assembly according to claim 15 wherein the individual discrete wipers comprises an elongated blade which is aligned substantially perpendicular to the longitudinal axis.

* * * * *

UNITED STATES PATENT AND TRADEMARK OFFICE

CERTIFICATE OF CORRECTION

PATENT NO. : 5,694,157

DATED : December 2, 1997

INVENTOR(S) : Ahlvin

It is certified that error appears in the above-identified patent and that said Letters Patent is hereby corrected as shown below:

Column 5 (line 5), after "station" delete "."

In the Claims

Column 7 (line 39), delete "cartage" and insert therefor --carriage--.

Column 8 (line 5), delete "prim" and insert therefor --print--.

Column 8 (line 18), delete "arc" and insert therefor --are--.

Signed and Sealed this

Sixteenth Day of June, 1998

Bruce Lehman

*Attest:*

BRUCE LEHMAN

*Attesting Officer*

*Commissioner of Patents and Trademarks*